US007758713B2

(12) United States Patent
Morlacchi

(10) Patent No.: US 7,758,713 B2
(45) Date of Patent: Jul. 20, 2010

(54) PROCESS AND MACHINE FOR WATER PROOFING SEMIMANUFACTURED FOOTWEAR, CLOTHING ITEMS AND ACCESSORIES, AND SEMIMANUFACTURED PRODUCTS OBTAINED WITH SAID PROCESS OR MACHINE

(75) Inventor: Luca Morlacchi, Legnano (IT)

(73) Assignee: Nextec S.R.L., Busto Arsizio VA (IT)

( * ) Notice: Subject to any disclaimer, the term of this patent is extended or adjusted under 35 U.S.C. 154(b) by 1259 days.

(21) Appl. No.: 10/559,967

(22) PCT Filed: Jun. 18, 2004

(86) PCT No.: PCT/IT2004/000351

§ 371 (c)(1),
(2), (4) Date: Dec. 7, 2005

(87) PCT Pub. No.: WO2004/112525

PCT Pub. Date: Dec. 29, 2004

(65) Prior Publication Data

US 2006/0123567 A1 Jun. 15, 2006

(30) Foreign Application Priority Data

Jun. 20, 2003 (IT) ..... MI2003A1258

(51) Int. Cl.
*A43D 9/00* (2006.01)

(52) U.S. Cl. ..... 156/196; 156/212; 156/213; 156/583.3; 156/382; 12/142 R

(58) Field of Classification Search ..... 156/583.3, 156/382, 213, 212, 196; 36/4, 55; 12/142 A, 12/142 R, 146 C See application file for complete search history.

(56) References Cited

U.S. PATENT DOCUMENTS 2,211,247 A * 8/1940 Victor et al. ..... 428/134
5,244,716 A * 9/1993 Thornton et al. ..... 428/198

(Continued)

FOREIGN PATENT DOCUMENTS

| | | |
|---|---|---|
| DE | 100 31 827 C 1 | 6/2000 |
| GB | 2 290 455 | 1/1996 |
| RU | 2195806 C2 * | 1/2003 |
| WO | WO 02/11571 A1 | 2/2002 |

*Primary Examiner*—Khanh Nguyen
*Assistant Examiner*—Keith T Aziz
(74) *Attorney, Agent, or Firm*—Lucas & Mercanti, LLP

(57) ABSTRACT

Process for waterproofing semimanufactured footwear, clothing items and accessories, said semimanufactured product having a three-dimensional conformation with at least one inner surface and one outer surface, which comprises the following operative steps:

arranging the semimanufactured product onto a shaped support (14; 27, 28; 30, 31) with at least one waterproofing sheath (18) shaped for entirely or partially cover the surfaces to be waterproofed of the semimanufactured product, at least one glue layer being arranged between these surfaces and the waterproofing sheath (18);

pressing between two deformable plates (2, 2') the semimanufactured product provided with the waterproofing sheath (18) and arranged on the shaped support (14; 27, 28; 30, 31).

The present invention also relates to a machine that carries out said process, as well as the semimanufactured products obtained with said process or machine.

15 Claims, 3 Drawing Sheets

U.S. PATENT DOCUMENTS 5,253,434 A 10/1993 Curley, Jr. et al.
5,685,091 A 11/1997 Yalamanchili
5,983,524 A * 11/1999 Polegato ..... 36/3 R
6,065,227 A * 5/2000 Chen ..... 36/4
6,497,786 B1 * 12/2002 Kilgore et al. ..... 156/379.8
7,356,946 B2 * 4/2008 Hannon et al. ..... 36/45

* cited by examiner

PROCESS AND MACHINE FOR WATER PROOFING SEMIMANUFACTURED FOOTWEAR, CLOTHING ITEMS AND ACCESSORIES, AND SEMIMANUFACTURED PRODUCTS OBTAINED WITH SAID PROCESS OR MACHINE

This patent application claims the benefit of priority from Italian Patent Application No. MI2003A001258 filed Jun. 20, 2003 through PCT Application Serial No. PCT/IT2004/000351 filed Jun. 20, 2003, the contents of which are incorporated herein by reference.

The present invention relates to a process for waterproofing semimanufactured footwear, clothing items and accessories, in particular during their manufacture. The present invention also relates to a machine that carries out said process, as well as the semimanufactured products obtained with said process or machine.

WO 00/22948 discloses a process for waterproofing leather and semimanufactured products made up of pieces of leather sewn to each other. This known process comprises a pressing onto the inner surface of the leather of at least one semipermeable membrane, whose surface contacting the leather is provided with a glue pattern. With this arrangement a suitable transpiration of the leather is achieved also in the zones where it is glued to the membrane.

WO 02/11571 discloses instead a process and a device for waterproofing semimanufactured products made of leather or fabric, also joined with other materials, which cannot be completely spread on a table since they have already taken during the manufacture a three-dimensional conformation with at least one inner surface and one outer surface. A typical example of said manufactured products are the uppers of footwear, considered in their final working step, before the application of an inner lining, if any. Other semimanufactured products of this kind can be boot uppers, gloves, hats and clothes in general in the final step of their manufacture. Said process comprises the inside out turning of the semimanufactured product and the introduction of a suitably shaped member before the pressing, so as to waterproof the semimanufactured product even if it has already taken a three-dimensional conformation. Said device includes instead a press provided with deformable plates made up of a hollow body having an elastic pressing surface urged outwards by hot air under pressure.

However, said known processes and device, so as they are disclosed in said patent applications, are not particularly suitable per se for an industrial application on a large scale, where a high automation degree is necessary for trying to reduce the manufacture times and costs.

It is therefore an object of the present invention to provide a process and a machine free from said disadvantages, i.e. which can be easily applied to an industrial production. Said object is achieved with a process the main features of which are described in claim 1, respectively, while other features are described in the remaining claims.

Thanks to the use of the particular waterproofing sheath shaped and provided with glue, the process and the machine according to the present invention can waterproof the semimanufactured products in a simple and quick manner, so as to allow their automated production, especially if the glue is thermoactivable.

The machine according to the present invention is particularly suitable for the automated production thanks to the deformable plates which are pivoted to a support structure and can press a mobile shaped support suitable for supporting the semimanufactured product and the waterproofing sheath during the pressing.

According to a particular aspect of the invention, the deformable plates can rotate around a substantially vertical axis and the shaped member can run on horizontal rails, so that the operator can easily arrange the semimanufactured product and the waterproofing sheath on the same support.

According to another particular aspect of the invention, the machine is provided with two shaped supports which can be pressed alternately, so that while the first one is pressed, the second one is prearranged by the operator with the semimanufactured product and the waterproofing sheath, and vice versa, so as to double the productivity.

According to a further particular aspect of the invention, the devices for the movement of the mobile components of the machine are driven in a pneumatic manner, so as to simplify its maintenance and to improve its reliability. Further, the particular arrangement of the machine parts prevents the accidental access to the pressing device, so as to improve the overall security.

Another advantage of the process and the machine according to the present invention lies not only in their high productivity, but also in the relatively low costs for their carrying out, so that they can be employed not only in the industrial production, but also in the handicraft production, in particular of footwear.

Further advantages and features of the process and the machine according to the present invention will become clear to those skilled in the art from the following detailed and non-limiting description of an embodiment thereof with reference to the attached drawings, wherein.

Figure 1:
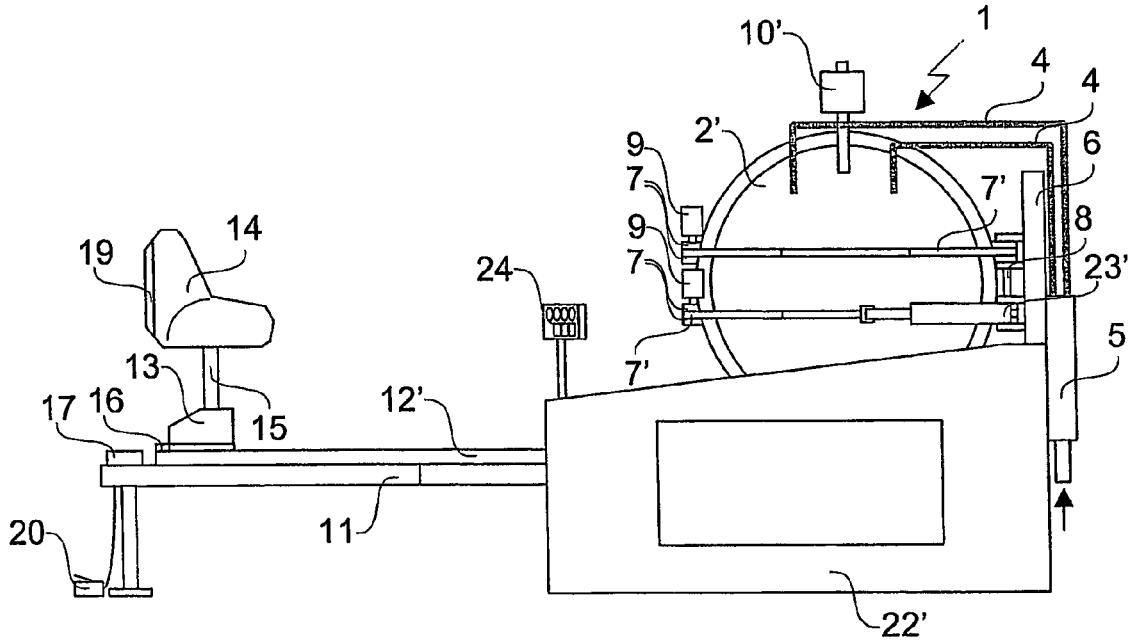
FIG. 1 shows a side view of said machine.
Figure 2:
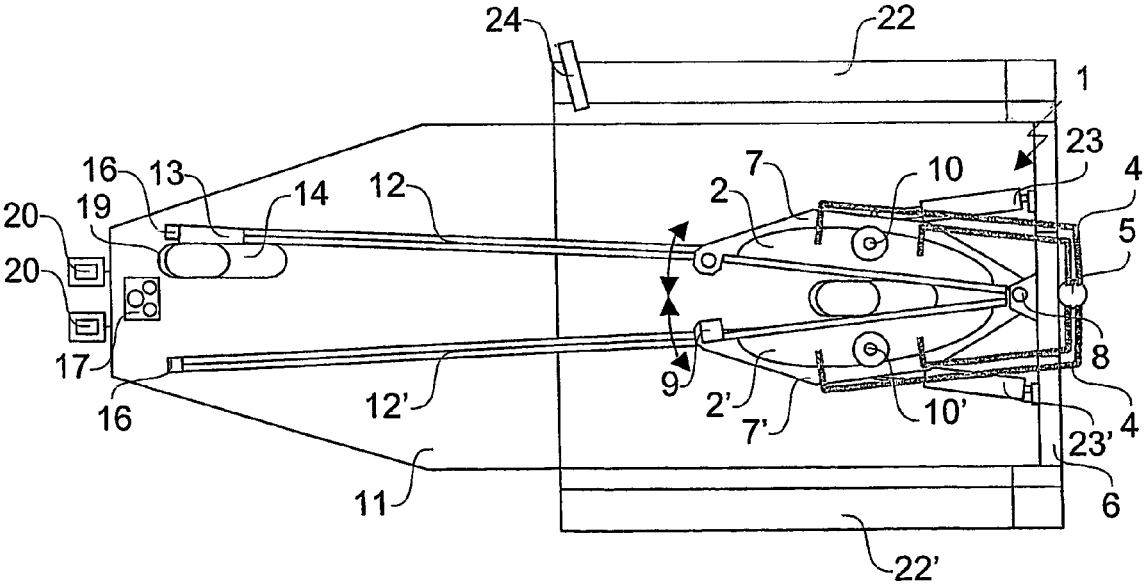
FIG. 2 shows a top view of the machine of FIG. 1.
Figure 3:
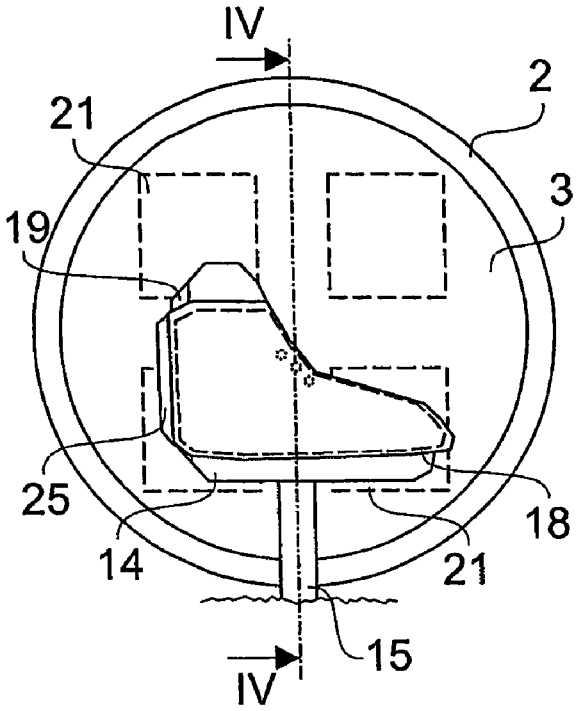
FIG. 3 shows a side view of the pressing device of the machine of FIG. 1.
Figure 4:
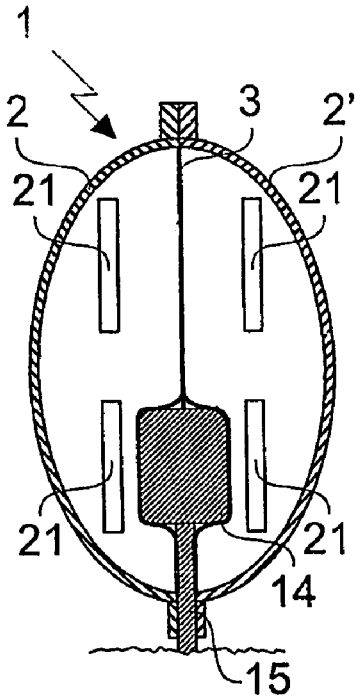
FIG. 4 shows a view sectioned along plane IV-IV of the pressing device of FIG. 3.

Referring to FIGS. 1 to 4, it is seen that the machine according to the present embodiment of the invention comprises in a known way a pressing device 1 having at least one pair of deformable plates 2, 2' made up of a hollow body, for example having the shape of a spherical cap, the pressing surface 3 of which is elastic, for instance made of silicone or another elastic, antiadherent and heat-resistant material. A fluid, in particular air, coming from a compressor (not shown in the figures) can be pumped through one or more inlet ducts 4 provided with pneumatic valves (not visible in the figures) into the deformable plates 2, 2', after it has been heated by at least one electric heat exchanger 5.

According to the invention, at least one of the deformable plates 2, 2' is pivoted to a vertical support structure 6 so as to rotate (in the direction of the arrows of FIG. 2) around a substantially vertical axis for opening or closing the pressing device 1 during the pressing steps. For this purpose, four arms 7, flat and curved, are fixed outside the deformable plate 2 and two arms 7', also flat and curved, are fixed outside the deformable plate 2 at suitable height so that each arm 7' is arranged between two of the four arms 7. The ends of arms 7, 7' close to the vertical support 6 are perforated, so that at least one pin 8, around which the deformable plates 2, 2' can rotate, can be inserted in the holes made at one of the two ends. In the present embodiment the deformable plates 2, 2' rotate around a single pin 8, i.e. around a same substantially vertical axis.

The piston of one or more pneumatic cylinders 9 acting as bolts for locking the deformable plates 2, 2' when they are closed can penetrate into the holes arranged at the end of arms 7, 7' opposite to the support structure 6 and prevent their accidental opening due to the high pressure between the pressing surfaces 3. At the end of the pressing, the fluid contained in the deformable plates 2, 2' can be discharged outside through one or more outlet ducts 10, 10' provided with pneumatic valves (not visible in the figures) and means for cooling and/or dispersing the hot fluid.

The support structure 6 is joined at the end of a horizontal platform 11 on which at least one rail, preferably two rails 12, 12' converging toward the pressing device 1, are arranged. A carriage 13 driven in a pneumatic way can run on each rail 12, 12' for alternately transporting to the same central position between the deformable plates 2, 2' of the pressing device 1 two shaped supports 14 mounted onto carriages 13 by means of a flat rod 15. Pneumatic sensors 16 are arranged at the ends of rails 12, 12' for detecting the position of carriages 13. A control panel 17 arranged on platform 11 comprises two buttons for controlling the movement of carriages 13, as well as a security button for stopping the working of the whole machine.

The shaped supports 14 have a shape suitable for supporting a semimanufactured product made of leather or fabric having a three-dimensional conformation with at least one inner surface and one outer surface, for example the upper of a footwear (shown with broken lines in FIG. 3), which is preferably turned inside out before it is arranged around the shaped support 14, so that its inner surface is turned outside.

At least one waterproofing sheath 18 shaped for entirely or partially cover the inner surface, preferably turned inside out, of the semimanufactured product to be waterproofed, is in turn put on the latter, so as to waterproof it when the pressing device 1 hot-presses it. The outer surface of the shaped supports 14 is preferably provided with at least one elastic, anti-adherent and heat-resistant coating, in particular made of silicone, and is shaped so as to adhere to the surfaces of the semimanufactured product and to compensate their irregularities, if any, for example caused by accessories such as metal loops or double applique, which create thickness irregularities and contact discontinuities between the surfaces of the semimanufactured product and sheath 18.

The surface of sheath 18 turned toward the semimanufactured product is provided with a glue pattern which can be thermally activated by the heat of the pressing device 1 for the time necessary for the fusion of the glue and to its penetration into the material of the semimanufactured product. In another embodiment, the glue can be sprayed onto the semimanufactured product before the latter is coupled with sheath 18.

In the present embodiment the glue pattern is made up of a plurality of dots of polyurethane glue, having a diameter comprised between 0.1 mm and 2 mm and a density comprised between 10 dots/cm$^2$ and 200 dots/cm$^2$. In other embodiments of the present invention the glue pattern may be made up of glue sprayed or arranged according to dot matrixes, also with a random pattern, or along mutually parallel and/or perpendicular lines. Sheath 18 preferably comprises at least one membrane made up of a sheet of a semi-permeable material, for instance made of polyurethane, polytetrafluoroethylene, polyester or other polymers, the thickness of which is preferably comprised between 5 mm and 100 mm. In particular, the semi-permeable membrane of sheath 18 according to the present embodiment of the invention is made of polyurethane. Further, it is preferably elastic, with a coefficient of elongation higher than 50%, in particular 100%, and it is non-porous, since it carries out the passage of the water vapor by osmosis, and therefore, differently form the porous membranes, the water passage is prevented even when it is pulled or bent. The surface of sheath 18 which is not provided with the glue pattern is generally fastened to a support sheet which avoids its possible accidental breakage or bending before the application. Said sheet can be made of paper and can be detached after that sheath 18 has been adhered to the semimanufactured product. In other embodiments of the present invention, the support sheet can be made of different materials, for example fabric or a similar material, preferably elastic, and be firmly fastened to sheath 18 if it is desired that the semimanufactured product is internally lined at the end of the processing. Further information about the membrane used for sheath 18 is contained in WO 00/22948 and WO 02/11571.

The shaped supports 14 can be expanded for stretching the surfaces of the semimanufactured product and of sheath 18 before they are pressed, so as to avoid wrinkles. For this purpose, each shaped support 14 comprises at least one mobile member 19 suitable to be pushed outside by one or more pneumatic cylinders arranged in the same support.

If the semimanufactured product to be waterproofed is the upper of a footwear, the shaped support 14, as in the present embodiment, is similar to a foot and the mobile member 19 is arranged in the position of the heel and is fixed preferably in a removable manner to the shaped support 14 so as to substitute it with other mobile members having different sizes, so as to adapt the shaped support 14 to shoe uppers having different sizes. The expansion of each shaped support 14 is controlled by a pedal 20, while it automatically retracts when carriage 13 goes back to the start position and activates sensor 16.

One or more heating members 21, for example electrically heated plates, are preferably arranged inside the deformable plates 2, 2' for further heating by conduction and convection the fluid contained therein, as well as the pressing surfaces 3 by irradiation.

A pair of vertical containers 22, 22' are arranged on both sides of the pressing device 1. Container 22 houses the control and security devices of the electric circuit for cheating the heat exchanger 5 and the heating members 21, while container 22' houses the control devices of the pneumatic circuit for driving the valves of the inlet ducts 4 and of the outlet ducts 10, 10, cylinders 9, carriages 13 and the mobile members 19 according to sensors 16. Also the deformable plates 2, 2' are preferably rotated in a pneumatic manner by two cylinders 23, 23' hinged between the support structure 6 and arms 7, 7', so that the working of the machine is completely automatic since the operator pushes a button of the control panel 17. Finally, a display panel 24 shows the working parameters of the machine according to the present invention, in particular the temperature and the pressure inside the deformable plates 2, 2'.

The pressing device 1 is closed laterally by containers 22, 22' and at the back by the support structure 6, while platform 11 extends frontally; so as to prevent the accidental access to the pressing device 1.

If the semimanufactured product to be waterproofed is a shoe upper, sheath 18 may consist of at least one piece of membrane cut with the size of the inner surface of the upper and folded so as to superimpose two edges thereof near the heel and/or the central front portion of the upper. Said edges are then hot-welded, for example by means of two heated bars, before the pressing, so as to form at least one strip 25 and give to sheath 18 a three-dimensional conformation similar to the upper to be waterproofed. A waterproofing tape is applied, in particular by means of hot-welding, astride strip 25 after the pressing for preventing the water penetration through its edges.

In other embodiments of the present invention, sheath 18 is arranged on the shaped support 14 with the surface provided with glue turned outside, after which the semimanufactured product is arranged on the shaped support 14, so that its inner surface contacts the outer surface of sheath 18 provided with glue. In this case, the glue can be activated during the pressing by heating means, for example one or more electric resistors, arranged in the shaped support 14.

Figure 5:
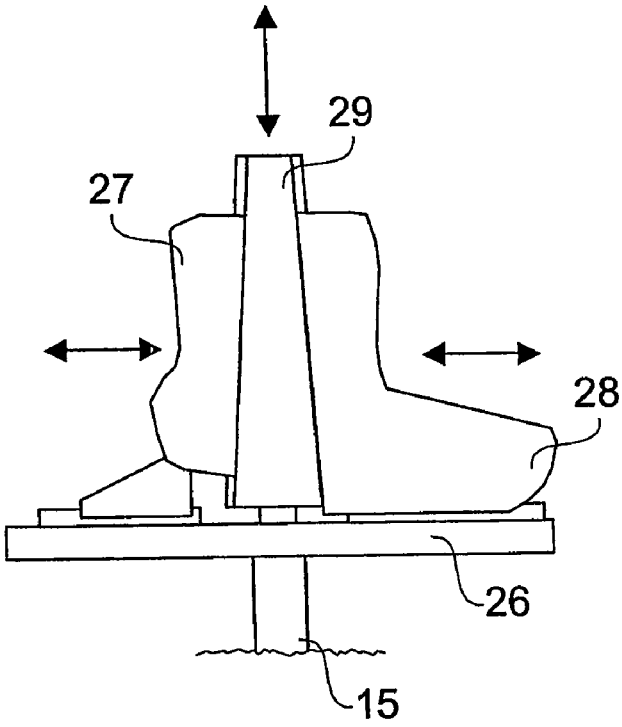
FIG. 5 shows a side view of a second shaped support for the machine of FIG. 1.

Referring to FIG. 5, it is seen that a second shaped support for the process and the machine according to the present invention comprises a horizontal guide 26 arranged on rod 15. A pair of shaped members 27, 28 comprising the heel and the tip, respectively, of a feet can run longitudinally on guide 26 in the direction of the horizontal arrows. A wedge 29 can further slide transversally between the shaped members 27, 28 in the direction of the vertical arrow, so as to move away or near these shaped members 27, 28, for stretching or loosening, respectively, a semimanufactured product, in particular an upper, arranged with its sheath on the shaped members 27, 28.

Figure 6:
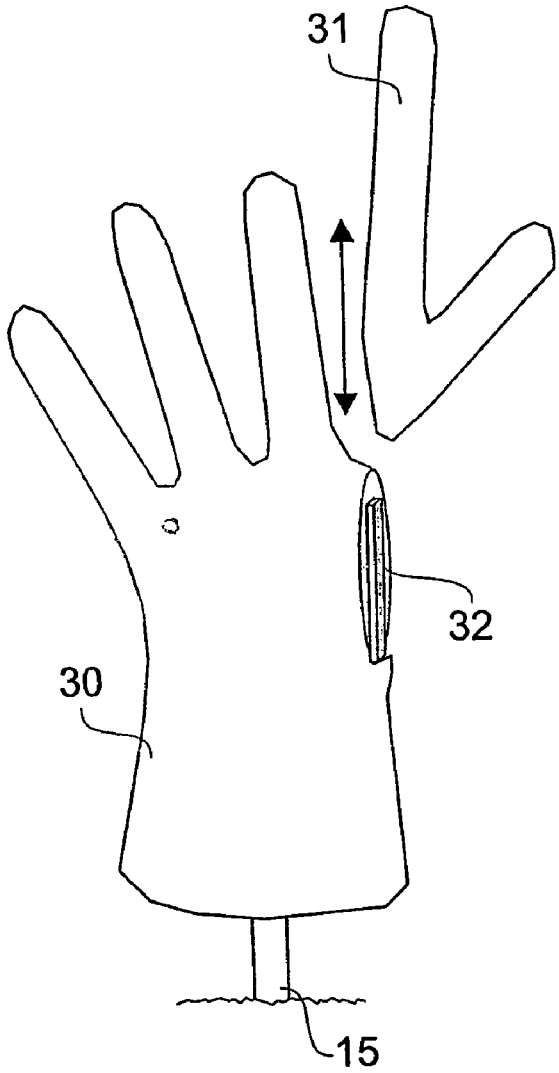
FIG. 6 shows a perspective view of a third shaped support.

Referring to FIG. 6, it is seen that a third shaped support comprises a first shaped member 30 which is arranged on rod 15 and has a shape substantially equal to a hand portion including at least one finger, in particular middle, ring and little fingers. At least one second shaped member 31 having a shape substantially equal to a hand portion including at least one finger, in particular forefinger and thumb, can be mounted onto the first shaped member 30, in particular with a dovetail joint 32, so that it is possible to slip the second shaped member 31 into a glove provided with the sheath and then insert the glove with the second shaped member 31 onto the first shaped member 30 in the direction of the vertical arrow, until the two shaped members 30, 31 are mutually coupled, so as to stretch the glove.

Further changes and/or additions can be made by those skilled in the art to the hereinabove described and illustrated embodiments, while remaining within the scope of the same invention.

The invention claimed is:

1. A process for waterproofing a semimanufactured product including footwear, clothing items and accessories, having a three-dimensional conformation with at least one inner surface and one outer surface, the process comprising the following operative steps:

cutting at least one piece of semi-permeable membrane, which is part of a waterproofing sheath, to a size of the inner surface of the semimanufactured product;

folding the piece of semi-permeable membrane;

superimposing two edges of the piece of the folded semi-permeable membrane;

welding the edges of the piece of the folded semi-permeable membrane to form at least one strip and to give the waterproofing sheath a three-dimensional conformation;

arranging at least one layer of glue between surfaces to be waterproofed and the waterproofing sheath;

arranging the semimanufactured product onto a shaped support with the waterproofing sheath shaped for entirely or partially covering the surfaces to be waterproofed of the semimanufactured product; and pressing between two deformable plates the semimanufactured product provided with the waterproofing sheath and arranged on the shaped support.

2. The process according to claim 1, wherein the glue is thermoactive and is heated during the pressing so that the waterproofing sheath is joined to the semimanufactured product.

3. The process according to claim 1 or claim 2, wherein the semimanufactured product is turned inside out before it is arranged on the shaped support so that the outer surface is turned toward the shaped support and the inner surface is turned toward the waterproofing sheath.

4. The process according to claim 1, wherein the shaped support is expanded before the pressing.

5. The process according to claim 1, wherein the outer surface of the shaped support has at least one elastic, anti-adherent and heat-resistant coating.

6. The process according to claim 1, wherein the outer surface of the shaped support is shaped so as to adhere to the surfaces of the semimanufactured product which are turned toward the shaped support during the pressing and to compensate for any irregularities in the surfaces of the semimanufactured product.

7. The process according to claim 1, wherein the glue is distributed onto the waterproofing sheath before the waterproofing sheath is coupled with the semimanufactured product.

8. The process according to claim 7, wherein the glue is distributed onto the waterproofing sheath in a discontinuous manner.

9. The process according to claim 1, wherein the waterproofing sheath comprises at least one membrane made of a semi-permeable material.

10. The process according to claim 1, wherein the semi-permeable membrane is non-porous and carries out a passage of water vapor by osmosis.

11. The process according to claim 1, wherein the waterproofing sheath comprises an elastic fabric coupled with the semi-permeable membrane.

12. The process according to claim 7 or 8, wherein the surface of the waterproofing sheath turned toward the semimanufactured product is provided with a glue pattern.

13. The process according to claim 1, wherein a waterproofing tape is applied astride the strip after the pressing.

14. A process for waterproofing a semimanufactured product including footwear, clothing items and accessories, having a three-dimensional conformation with an inner surface and an outer surface, the process comprising the following operative steps:

preparing a waterproofing sheath, which comprises at least one membrane made of semi-permeable material;

applying a layer of glue to a piece of the semi-permeable membrane;

cutting the piece of semi-permeable membrane to a size of the inner surface of the semimanufactured product;

folding the piece of semi-permeable membrane;

superimposing two edges of the folded piece of the semi-permeable membrane;

welding the edges of the folded piece of semi-permeable membrane to form at least one strip and to give the waterproofing sheath a three-dimensional conformation;

arranging the semimanufactured product onto a shaped support with the waterproofing sheath shaped for entirely or partially covering surfaces to be waterproofed of the semimanufactured product; and pressing the semimanufactured product, which is arranged on the shaped support with the waterproofing sheath, between two deformable plates.

15. A process for waterproofing a semimanufactured product including footwear, clothing items and accessories, having a three-dimensional conformation with an inner surface and an outer surface, the process comprising the following operative steps:

preparing a waterproofing sheath, which comprises at least one membrane made of semi-permeable material;

cutting a piece of semi-permeable membrane to a size of the inner surface of the semimanufactured product;

folding the piece of semi-permeable membrane;

superimposing two edges of the folded piece of the semi-permeable membrane;

welding the edges of the folded piece of semi-permeable membrane to form at least one strip and to give the waterproofing sheath a three-dimensional conformation;

applying a layer of glue to surfaces of the semimanufactured product;

arranging the semimanufactured product onto a shaped support with the waterproofing sheath shaped for entirely or partially covering the surfaces to be waterproofed of the semimanufactured product; and pressing the semimanufactured product, which is arranged on the shaped support with the waterproofing sheath, between two deformable plates.

* * * * *